US010874890B2

(12) United States Patent
Renck et al.

(10) Patent No.: US 10,874,890 B2
(45) Date of Patent: Dec. 29, 2020

(54) FIRE RETARDANT AND MITIGATION COMPOSITIONS AND AGENTS

(71) Applicant: Fire Mitigation Technologies, LLC, Stateline, NV (US)

(72) Inventors: Kenneth Renck, Aguanga, CA (US); Darryl Dean Cleveland, Reno, NV (US)

(73) Assignee: Fire Mitigation Technologies, LLC, Stateline, NV (US)

( * ) Notice: Subject to any disclaimer, the term of this patent is extended or adjusted under 35 U.S.C. 154(b) by 50 days.

(21) Appl. No.: 16/291,909

(22) Filed: Mar. 4, 2019

(65) Prior Publication Data

US 2019/0269952 A1 Sep. 5, 2019

Related U.S. Application Data

(60) Provisional application No. 62/638,894, filed on Mar. 5, 2018.

(51) Int. Cl.
*A62D 1/00* (2006.01)

(52) U.S. Cl.
CPC ..... *A62D 1/0042* (2013.01)

(58) Field of Classification Search
CPC ..... A62D 1/0042
See application file for complete search history.

(56) References Cited

U.S. PATENT DOCUMENTS

| | | | | |
|---|---|---|---|---|
| 4,950,410 | A | 8/1990 | Pennartz | |
| 4,961,865 | A | 10/1990 | Pennartz | |
| 5,091,097 | A | 2/1992 | Pennartz | |
| 8,080,186 | B1 | 12/2011 | Pennartz | |
| 9,265,978 | B2 | 2/2016 | Klaffmo | |
| 2006/0113513 | A1* | 6/2006 | Nilsson | C09K 21/04 252/601 |
| 2007/0289752 | A1* | 12/2007 | Beck | A62D 1/0071 169/47 |
| 2009/0223559 | A1 | 9/2009 | Kubo | |
| 2010/0068400 | A1* | 3/2010 | Reimann | C09K 21/04 427/395 |
| 2011/0073795 | A1 | 3/2011 | Thomas | |
| 2011/0089362 | A1 | 4/2011 | Peng | |
| 2012/0010346 | A1 | 1/2012 | La Rosa | |
| 2017/0056698 | A1* | 3/2017 | Pai | A62D 1/0042 |

FOREIGN PATENT DOCUMENTS

| | | |
|---|---|---|
| CN | 103751941 | 4/2014 |
| WO | 8800482 | 1/1988 |

OTHER PUBLICATIONS

Salaun et al., "Thermo-physical properties of polypropylene fibers containing a mircoencapsulated flame retardant," Polymers for Advanced Technology, vol. 24, Issue 2 (Feb. 2013), p. 236-248.
Li, et al., "Preparation of Flame Retardant Modified with Titanate for Asphalt Binder," Advances in Materials Science and Engineering, vol. 2014 (Oct. 15, 2014), p. 1-8.
Hao, et al., "Effect of Magnesium Hydroxide on the Flame Retardant Properties of Unsaturated Polyester Resin," Procedia Engineering, vol. 52 (Dec. 2013), p. 336-341.
International Search Report for PCT/US2019/20589 dated May 24, 2019.

* cited by examiner

*Primary Examiner* — Mark Kopec
*Assistant Examiner* — Jaison P Thomas
(74) *Attorney, Agent, or Firm* — The Myers Law Group

(57) ABSTRACT

A fire mitigation composition that includes by weight one to five percent potassium hydroxide, two to seven percent citric acid, four to thirty-six percent diammonium phosphate, four to twenty percent carbamide, forty-five to sixty percent deionized water, zero to five percent capryloamphodipropionate, two to six percent tridol 6, and four to seven percent cocamidopropyl betaine.

14 Claims, No Drawings

FIRE RETARDANT AND MITIGATION COMPOSITIONS AND AGENTS

PRIORITY CLAIM

This application claims the priority date of provisional application No. 62/638,894 filed on Mar. 5, 2018, which is herein incorporated by reference in its entirety.

BACKGROUND

The present disclosure relates generally to fire retardant and mitigation compositions and agents with eco-friendly properties and applications.

Commonly used fire retardant compositions and formulas typically contain compositions that are not environmentally friendly and contribute to the pollution and/or damage of a fire event. Moreover, these fire retardant compositions are also inefficient in extinguishing fires, which leads to longer extinguishing times and a greater use of the fire retardant composition and/or water. A fire retardant and mitigation composition and agent are needed to improve the effectiveness, quality, and speed of extinguishing a variety of fire types as well as comporting with environmental issues that arise by virtue of fires, fire-fighting, and the aftermath of clean-up efforts.

SUMMARY

A fire mitigation composition, comprising a strong base, from one to five percent by weight; a weak acid, from two to seven percent by weight; a water soluble ammonium phosphate salt, from four to thirty-six percent by weight; a nitrogenous organic compound, from four to twenty percent by weight; deionized water, from forty-five to sixty percent by weight; a first surfactant, from zero to five percent by weight; a second surfactant, from two to six percent by weight; and a third surfactant, from four to seven percent by weight. A fire mitigation composition, comprising potassium hydroxide from one to five percent by weight; citric acid, from two to seven percent by weight; diammonium phosphate, from four to thirty-six percent by weight; carbamide, from four to twenty percent by weight; deionized water, from forty-five to sixty percent by weight; capryloamphodipropionate, from zero to five percent by weight; tridol 6, from two to six percent by weight; and cocamidopropyl betaine, from four to seven percent by weight.

A method of making a fire mitigation composition for suppressing Class A and Class B fires, comprising the steps of mixing the following groups of components on a percent by weight basis: mixing Group A components comprising potassium hydroxide from one to five percent by weight; citric acid, from two to seven percent by weight; diammonium phosphate, from four to thirty-six percent by weight; carbamide, from four to twenty percent by weight; deionized water, from forty-five to sixty percent by weight at 600-700 rpm; mixing Group B components comprising capryloamphodipropionate, from zero to five percent by weight and tridol 6, from two to six percent by weight, at 600-700 rpm; mixing the Group B components with the Group A components; and mixing Group C components comprising cocamidopropyl betaine, from four to seven percent by weight with the mixture of Group A and Group B for twenty minutes until the composition becomes substantially clear in color.

DESCRIPTION OF THE PREFERRED EMBODIMENTS

The detailed descriptions set forth below are intended as a description of embodiments of the invention, and is not intended to represent the only forms in which the present invention may be constructed and/or utilized. The descriptions set forth the structure and the sequence of steps for constructing and operating the invention. It is to be understood, however, that the same or equivalent structures and steps may be accomplished by different embodiments that are also intended to be encompassed within the spirit and scope of the invention.

The present invention relates to a fire retardant and mitigating composition, agent and/or formula that may be utilized in connection with various flammable and combustible materials, including, but not limited to ordinary combustibles, liquids, gasses, electrical, metal, and kitchen fires, and subject to testing and applicable approval procedures for Class A, B, C, and K fires. In its exemplary forms, such fire mitigation composition may comprise a concentrate form or a 10× diluted form, and may contain a strong base, a weak acid, a water-soluble ammonium phosphate salt, and an active hydrogen containing nitrogenous organic compound, and one or more surface tension reducing components, such as surfactants.

The exemplary concentrate form of the fire mitigation composition comprises super-wetting, endothermic, and emulsifying properties that are particularly suitable for Class A and Class B fire types. Class A fires typically involve combustible fuels, such as wood, wool, cotton, and vegetation, among other such related items. Class B fires typically involve liquid hydrocarbon fuels, such as petroleum, petrol, diesel, oils, and grease, among others.

In an exemplary embodiment of the fire mitigation composition as a concentrate for Class A type fires, the following components may be mixed together according to a percentage by weight basis (or weight percent), namely: (A) four percent (4%) to twenty percent (20%) carbamide (urea) [i.e., a nitrogenous organic compound); four percent (4%) to thirty-six percent (36%) diammonium phosphate [i.e., a water soluble ammonium phosphate salt]; two percent (2%) to seven percent (7%) citric acid [i.e., a weak acid]; one percent (1%) to five percent (5%) potassium hydroxide [i.e., a strong base]; forty-five percent (45%) to sixty percent (60%) deionized water; (B) between zero percent (0.0%) to five percent (5%) capryloamphodipropionate (or disodium capryloamphodipropionate) [i.e., a surfactant]; two percent (2%) to six percent (6%) tridol 6 [i.e., a surfactant]; and (C) four percent (4%) to seven percent (7%) cocamidopropyl betaine [i.e., a surfactant]. As indicated earlier, the foregoing may be used with Class A fires, and may serve to alleviate environmental concerns that are often encountered once a fire is extinguished and clean-up efforts are in play. In an alternate embodiment of the foregoing, the following fluorosurfactant component may be integrated into the components of group (B): one percent (1.0%) to three percent (3.0%) of an amphoteric fluorinated surfactant, particularly for fires in settings where environmental concerns may not be of utmost priority, or for certain types of Class B fires, such as oil fires.

The fire mitigation composition in a concentrate form as applied to extinguishing Class A fuels has the ability to deeply penetrate the materials to which it is applied due to its significantly low surface tension properties when added to water. Further, its extinguishing properties also include high endothermic action to remove heat at a fast rate resulting in the ability to cool fuels below their respective flame points. For Class B fires, the fire mitigation composition in a concentrate form has extinguishing properties including through its endothermic action as well as emulsifying and hydrophilic actions on hydrocarbon fuels.

Each of the components of (A) and (B) listed above may be mixed separately through chemical mixing processes, including those known by one of ordinary skill in the art, and further including by mixing processes that largely avoid crystallization and foaming byproducts. The components of (A) may be mixed on a high speed, which may be between 600-700 revolutions per minute (RPM), and a similar process may be performed for the components of (B) of the same mixing speed range as (A). The components of (B) may then be added to the already mixed components of (A), and thereafter, the component of (C) may be mixed into the mixture of the (A) and (B) components for approximately twenty (20) minutes until the composition becomes substantially clear.

In the exemplary embodiment of the fire retardant composition, the color of the solution results in a clear amber color. Further, in the exemplary embodiment of the fire retardant composition as a concentrate, such composition may have a pH of between 7.0 to 8.0, a specific gravity of at least 1.0, and a refractive index of approximately 37.75.

In various testing environments, positive results were obtained in independent testing and head-to-head studies of the fire mitigation composition concentrate with respect to its overall surface tension and contact angles with polytetrafluoroethylene (PTFE) as well as inter-facial tensions with diesel fuel. The fire mitigation composition concentrate may have an approximate surface tension of 17.36 mN/m, compared to water, which is approximately 72,080 mN/m. The significantly low surface tension of the concentrate composition allows it the ability to rapidly and deeply penetrate fuel substrates of Class A and B fires. The concentrate composition also may have a polar component of approximately 0.67 mN/m, compared to water at 46.48 mN/m, which is related to the concentrate's miscibility and hydrophilic capabilities. The composition component also may have a dispersive component of approximately 16.69 mN/m compared to water's dispersive component of 26.32 mN/m, and which is relative to the composition concentrate's significantly low surface tension and its capacity to rapidly spread over and emulsify hydrocarbon fuels, such as Class B fuel fires. The composition concentrate may also have a surface polarity of approximately 3.88%, compared to water's surface polarity of 63.84%. The surface polarity component of the composition concentrate is related to its contract angle on hydrocarbon fuels and resulting hydrophilic action to emulsify hydrocarbon fuels as well as cease vapor production and effect continued fire suppression action. Furthermore, the fire mitigation composition concentrate has been UL tested and determined to be compliant with NFPA Standard 18.

In another embodiment of the fire mitigation composition as a concentrate for Class A/B type fires, the following components may be mixed together according to a percentage by weight basis (or weight percent), namely: (A) four percent (4%) to twenty percent (20%) urea (carbamide); four percent (4%) to thirty-six percent (36%) diammonium phosphate; two percent (2%) to seven percent (7%) citric acid; one percent (1%) to five percent (5%) potassium hydroxide; forty-five percent (45%) to sixty percent (60%) deionized water; (B) between zero percent (0.0%) to five percent (5%) capryloamphodipropionate (or disodium capryloamphodipropionate); two percent (2%) to six percent (6%) tridol 6; and one half percent (0.5%) to three percent (3.0%) of a nonionic surfactant, such as an alcohol ethoxylate and/or ethoxylate; and (C) four percent (4%) to seven percent (7%) cocamidopropyl betaine. As indicated earlier, the foregoing fire retardant concentrate composition may be used with type A/B fires, and also may serve to alleviate environmental concerns in clean-up efforts.

The environmental qualities of the fire composition concentrate have been further validated by independent third-party testing by various organizations and governmental agencies, including the Economic Co-operation and Development, Method 203; the United States Environmental Protection Agency (USEPA); the Office of Prevention, Pesticides, and Toxic Substances (OPPTS), Method 850-1075; and the United States Department of Agriculture (USDA), Forest Service Specification 5100-306a. For example, under the USDA standard and testing, the fire composition concentrate was found to be seventeen times less toxic for LC50 (Lethal Concentration, 50%) than the acceptable USDA ceiling for LC50. Yet as a further example, under the OECD and OPPTS testing methods, the fire composition concentrate was found to be thirty-five times less toxic than the acceptable method parameters for LC50. Yet further, in other independent lab studies, the fire composition concentrate for mammalian life resulted in having a significantly low toxicity level in relation to the LD50 measurement scale.

The fire retardant composition as a concentrate may be prepared in bulk with a minimum volume of five (5) gallons; however, it is contemplated that larger volumes of such concentrate may be prepared in its exemplary applications, such as for use by fire departments where substantially large volumes of fire retardants are necessary for combatting fires, among other related activities. For example, in a fire extinguisher sprayer device, the fire retardant concentrate composition may be used at a ratio of 1:10 (or 20) to water. However, it is expected that the fire mitigation composition may be used in various application systems by firefighters, whereby the fire mitigation composition is diluted through the manifold of the particular application device in use. For example, the fire mitigation composition in concentrate form may be batch mixed through the delivery equipment, such as a fire apparatus or pressurized water fire extinguisher device. It may be proportioned through the applicable on-board proportioning equipment/devices and/or may utilize a venturi eductor device in conjunction with containers of the fire mitigation composition in concentrate form. For Class A fires, the exemplary dilution for the concentrate composition may be up to three percent (3%) with water. For Class B fires, the exemplary dilution for the concentrate composition may be up to six percent (6%) with water.

Ideal storage conditions for the fire mitigation composition include storing it in dry areas out of direct sunlight, between 2-45 Celsius or above 32 Fahrenheit and below 120 Fahrenheit.

In addition to the concentrate form as described herein, such concentrate form may be used to create varying concentrations or dilutions of the fire mitigation composition by, for example, integrating a different weight percentage of the concentrate or of each component that may be suitable for different fire-fighting applications, devices, and systems.

Various aspects of the present invention are described herein according to embodiments of the invention. While particular forms of the invention have been described, it will also be apparent to those skilled in the art that various modifications can be made without departing from the spirit and scope of the invention. Accordingly, it is not intended that the invention be limited except by the claims.

The invention claimed is:

1. A fire mitigation composition, comprising:

a strong base, from one to five percent by weight;

a weak acid, from two to seven percent by weight;

a water soluble ammonium phosphate salt, from four to thirty-six percent by weight;

a nitrogenous organic compound, from four to twenty percent by weight;

deionized water, from forty-five to sixty percent by weight;

a first surfactant, from zero to five percent by weight;

a second surfactant, from two to six percent by weight; and a third surfactant, from four to seven percent by weight, wherein the third surfactant further comprises cocamidopropyl betaine; and wherein the composition has a surface polarity of 3.88%.

2. The composition of claim 1, wherein the strong base further comprises potassium hydroxide.

3. The composition of claim 1, wherein the weak acid further comprises citric acid.

4. The composition of claim 1, wherein the ammonium phosphate salt further comprises diammonium phosphate.

5. The composition of claim 1, wherein the nitrogenous organic compound further comprises carbamide.

6. The composition of claim 1, wherein the first surfactant further comprises capryloamphodipropionate.

7. The composition of claim 1, wherein the second surfactant further comprises tridol 6.

8. The composition of claim 1, wherein the first surfactant further comprises disodium capryloamphodipropionate.

9. The composition of claim 1, further comprising an amphoteric fluorinated surfactant.

10. A fire mitigation composition, comprising:

potassium hydroxide from one to five percent by weight;

citric acid, from two to seven percent by weight;

diammonium phosphate, from four to thirty-six percent by weight;

carbamide, from four to twenty percent by weight;

deionized water, from forty-five to sixty percent by weight;

capryloamphodipropionate, from zero to five percent by weight;

tridol 6, from two to six percent by weight; and cocamidopropyl betaine, from four to seven percent by weight; and wherein the composition has a surface polarity of 3.88%.

11. The composition of claim 10, wherein the composition has a surface tension of 17.36 mN/m.

12. The composition of claim 10, wherein the composition has a polar component of 0.67 mN/m.

13. The composition of claim 10, wherein the composition has a dispersive component of 16.69 mN/m.

14. The composition of claim 10, wherein the composition has a pH between 7.0 and 8.0.

* * * * *